US005702188A

United States Patent [19]

Watanabe et al.

[11] Patent Number: 5,702,188

[45] Date of Patent: Dec. 30, 1997

[54] THERMAL HEAD AND HEAD DRIVE CIRCUIT THEREFOR

[75] Inventors: Toshiya Watanabe; Masatoshi Noguchi; Takeshi Toyosawa; Minoru Morita, all of Yokohama, Japan

[73] Assignee: Graphtec Corporation, Yokohama, Japan

[21] Appl. No.: 678,677

[22] Filed: Jul. 11, 1996

[30] Foreign Application Priority Data

| | | | |
|---|---|---|---|
| Jul. 18, 1995 | [JP] | Japan | 7-203898 |
| Sep. 13, 1995 | [JP] | Japan | 7-260841 |
| Sep. 13, 1995 | [JP] | Japan | 7-260842 |

[51] Int. Cl.[6] ..... B41J 2/355

[52] U.S. Cl. ..... 400/120.05; 347/180

[58] Field of Search ..... 400/120.05–120.12; 347/180, 181, 182, 211

[56] References Cited

U.S. PATENT DOCUMENTS

| | | | |
|---|---|---|---|
| 4,360,818 | 11/1982 | Moriguchi | 347/180 |
| 4,404,567 | 9/1983 | Katsuragi | 347/180 |
| 4,575,732 | 3/1986 | Kitaoka | 347/180 |
| 5,066,960 | 11/1991 | Deguchi | 347/180 |
| 5,134,425 | 7/1992 | Yeung | 346/76 PH |
| 5,235,346 | 8/1993 | Yeung | 400/120.09 |
| 5,482,386 | 1/1996 | Thiel et al. | 400/120.12 |

FOREIGN PATENT DOCUMENTS

| | | | |
|---|---|---|---|
| 2 350 200 | 12/1977 | France | 400/120.01 |
| 56-32102 | 7/1981 | Japan | 400/120.01 |
| 58-128875 | 8/1983 | Japan | 400/120.01 |
| 61-277464 | 12/1986 | Japan | 400/120.01 |
| 2-92552 | 4/1990 | Japan | 400/120.01 |
| 5-208516 | 8/1993 | Japan | 400/120.01 |

*Primary Examiner*—Ren Yan
*Assistant Examiner*—Steven S. Kelley
*Attorney, Agent, or Firm*—Oliff & Berridge, P.L.C.

[57] ABSTRACT

A thermal head includes a thermal resistance member formed in a straight form, a first lead conductor group having a plurality of first lead conductors which are connected to the thermal resistance member, a second lead conductor group having a plurality of second lead conductors which are connected to the thermal resistance member, the first lead conductors and the second lead conductors being alternately arranged at a given interval, a third lead conductor group connected to the thermal resistance member between the first and second lead conductor groups, and a switch having a first selecting mode for selecting the first lead conductor group and a second selecting mode for selecting the second lead conductor group, wherein when the switch selects the first selecting mode, a region of the thermal resistance member sandwiched by the first lead conductor group and the third lead conductor group is heated, and when the switch selects the second selecting mode, a region of the thermal resistance member sandwiched by the second lead conductor group and the third lead conductor group is heated; and wherein the switch includes a potential applying unit for applying a preselected potential other than 0 to the second lead conductor group during the first selecting mode, and for applying a predetermined potential other than 0 to the first lead conductor group during the second selecting mode.

3 Claims, 8 Drawing Sheets

THERMAL HEAD AND HEAD DRIVE CIRCUIT THEREFOR

BACKGROUND OF THE INVENTION

1. Field of the Invention

The present invention relates to a thermal head used in a thermal recording apparatus and the like, and a head drive circuit of the head.

2. Description of the Related Art

FIG. 1 is a diagram for representing the structure of a conventional alternate lead type thermal head such that, for instance, power-source-sided conductors connected to a power source are subdivided into two groups every second conditions, and these subdivided conductors are sequentially switched to be connected to the power source, thereby driving thermal resistance members. Reference numeral 1 denotes a thermal resistance member, reference numeral 2 shows a drive IC, reference numerals 31, 32, - - - , **3*m* indicate a first lead conductor, and reference numerals 41, 42, - - - , 4*m* represent a second lead conductor. Also, reference numeral 5A is a first selecting line, reference numeral 5B shows a second selecting line, reference numerals 61, 62, - - - , 6*n* denote a third lead conductor, symbol "E" is a power source, symbol "SW" denotes a changing switch, and symbols D1, D2, - - - , Dn are diodes. In this thermal head, the thermal resistance member 1 is formed in a straight form on a ceramic substrate. The third lead conductors 6 which are in contact with this thermal resistance member 1 are provided on the side of the drive IC 2 along a direction perpendicular to this thermal resistance member 1. The first and second lead conductors 3, 4 which are provided on the side of the diodes D are alternately arranged in an equiinterval. The thermal resistance member 1 is segmented by the third lead conductor 6, and the first and second lead conductors 3, 4 to thereby form a plurality of thermal resistance elements R1, R2, R3 . . . . Also, the first and second lead conductors 3, 4 connected via the diode D to the first selecting line 5A and the second selecting line 5B. The changing switch SW switches the power source E and these selecting lines 5A, 5B to connect these elements. Also, the third lead conductors 6** are connected to the corresponding switches S1, S2, . . . , Sn of the drive IC2. These switches S are grounded.

When the recording operation is performed by this thermal head, the changing switch SW is switched at preselected timing by a control unit (not shown). At a first timing, the first selecting line 5A is connected to the power source E as a first mode, whereas at a second timing, the second selecting line 5B is connected to the power source E as a second mode. Thus, the changing switch SW sequentially repeatedly performs these two modes. On these two modes, the switches S1 S2, . . . , Sn within the drive IC2 are ON/OFF-controlled by the control unit to supply the power to the respective thermal resistance elements according to recording data.

In this drawing, for instance, when the recording data(um) correspond to the thermal resistance element R1 is applied to the control unit, the control unit closes the switch S1 and switches the changing switch SW to the contact A side. Accordingly, a current derived from the power source E may flow through the first selecting line 5A, the first lead conductor 31, the diode D1, the thermal resistance element R1, and the third lead conductor 61 into the thermal resistance element R1, so that this thermal resistance element R1 is heated. At this time, when the switch S2 is closed, the current from the power supply E may flow through a path similar to the above-described path, and the third lead conductor 62 into the thermal resistance element R2, so that the thermal resistance element R2 is heated. Moreover, when the thermal resistance element R3 has to be heated, the switch S2 is closed and also the changing switch SW is changed to the contact B side. Thus, a current from the power source E may flow through the second selecting lien 5B, the second lead conductor 41, the diode D2, and the third lead conductor 62 to the thermal resistance element R3, so that this thermal resistance element R3 is energized to be heated.

In other words, when the recording operation is carried out for 1 line, the control unit (not shown) subdivides the recording data for 1 line into the recording data processed by the A group thermal resistance element which is in contact with both sides of the first lead conductors 31 to **3*m* connected to the first selecting line 5A, and into also the recording data processed by the B group thermal resistance element which is in contact with both sides of the second lead conductors 41 to 4*m* connected to the second selecting line 5B. Then, the control unit controls the changing switch SW to thereby connect the first selecting line 5A to the power source E, and further transmits the A group recording data to the drive IC2 so as to turn ON/OFF the switches S1 to Sn. As a result, the A group's elements which designated "print ON" by the A group's recording data are heated. At the next timing, the changing switch SW is switched, so that the second selecting line 5B** is connected to the power source E. Also, the control unit transmits the B phase recording data to the drive IC2 so as to turn ON/OFF the switches S1 to Sn, so that the B phase thermal resistance elements are operated, and thus the recording operation for 1 line is completed.

In such a thermal head case, the diodes D1 to Dn are required in order to avoid that the current used to energize a preselected thermal resistance element is entered into other thermal resistance elements. This may cause the manufacturing cost to be increased, and also can hardly make the compact thermal head.

For eliminating these programs, as illustrated in FIG. 2, such an idea has been proposed that an interlock switch is provided with first and second selecting lines, and when one selecting line is connected to the power source E, the other selecting line is grounded. No diode is necessary in the first and second selecting lines 5A, 5B of this thermal head. According to this thermal head, the unnecessary current as indicated by "i2" is not concentrated into the thermal resistance elements which designated "print OFF" by the recording data. Also, the manufacturing cost, can be reduced and the thermal head can be made compact without employing the diodes.

Assuming now that the voltage of the power source is "E", the ground potential is "0", the resistance value of each thermal resistance element is "R", and the thermal resistance element R2 is designated "print ON", the amount of the current i1 which is allowed to flow into R2 is E/R. Then, the printing energy amount of this current becomes (E×E)/R. Another current i2 which is allowed to flow into the thermal resistance element designated "print OFF" is E/2R. Then, the printing energy amount of this current becomes (E*E) 4R. In this case, both the voltage E of the power source and the resistance value R of the thermal resistance element are set in such a manner that the printing energy amount ((E*E)/4R) of the thermal resistance element designated "print OFF" cannot give any change in the thermal recording paper.

In the above-explained conventional thermal head in FIG. 2, the ratio of the printing energy amount of the thermal resistance element originally to be heated to that of other thermal resistance element is 4:1. However, there is such a drawback that this ratio of 4:1 is relatively small. In other words, when the printing energy of the thermal resistance element designated "print OFF" is reduced to prevent the coloring print operation, the other printing energy of the thermal resistance element to be heated is short. Conversely, when the printing energy of the thermal resistance element to be heated is sufficiently large, the other printing energy of the thermal resistance element not to be heated is relatively increased. As a consequence, there is another demerit that since this relatively large printing energy would give adverse influences of heat storages, even if not causing the coloring print operation, very strict resistance value managements and controls are required.

SUMMARY OF THE INVENTION

The present invention has been made in view of the above circumstances, and is directed to such a thermal head having no diodes in the first and second selecting lines that energy given to a thermal resistance element designated "print OFF" is reduced to very small value.

A thermal head according to the present invention is so arranged that a potential applying means is provided, and when one of a first selecting line and a second selecting line is connected to the power source E, a predetermined potential other than 0 is applied to the other selecting line.

Since while one selecting line is connected to the power source E, a preselected potential other than 0 is applied to the other selecting line, a current which is allowed to flow into the thermal resistance element designated "print OFF" may be reduced. Thus, the energy given to the thermal resistance element may be decreased.

Also, a head drive circuit of a printing head according to the present invention is so designed that a plurality of printing elements mutually connected to each other are subdivided into at least two groups, both a printing signal and electric power are supplied to each group of the printing elements so as to perform a printing operation, and the power supplied to one group of the printing elements not under drive condition is varied in accordance with the print drive number of the other group of the driven printing elements, and there is provided a reverse-phase power source, while at least one group performs the printing operation, which is connected to the other group in order to set the varied power in the other group to a preselected amount, and also which owns an effect to sink a current of the other group and further another effect to supply a current to the other group.

Further, a head drive circuit of a printing head according to the present invention is so designed that a plurality of printing elements mutually connected to each other are subdivided into at least two groups, both a printing signal and electric power are supplied to each group of the printing elements so as to perform a printing operation, and the energy supplied to one group of the printing elements not under drive condition is varied in accordance with the print drive number of the other group of the driven printing elements, and a power source is employed, while at least one group performs the printing operation, in order to set the energy caused to the other group to a preselected value.

DETAILED DESCRIPTION OF THE PREFERRED EMBODIMENTS

Referring now to drawings, a thermal head of the present invention will be described more in detail.

Figure 3:
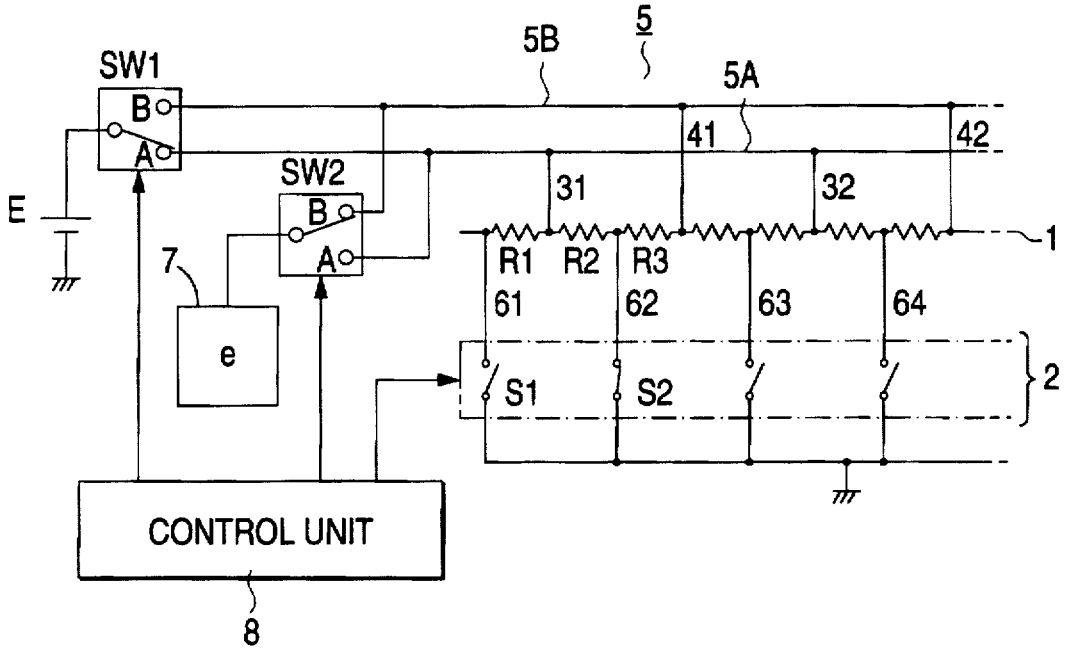
FIG. 3 is a connection diagram for showing a structure of a thermal head according to a first embodiment of the present invention.

FIG. 3 is a connection diagram for indicating an arrangement of the thermal head according to a first embodiment of the present invention. It should be understood that the same reference numerals used in the above-explained conventional thermal head will be employed as those for denoting the same or similar circuit elements of this thermal head. In FIG. 3, reference numeral 7 denotes a constant voltage circuit functioning as the potential applying means, symbols SW1 and SW2 represent changing switches, and reference numeral 8 is a control unit.

The constant voltage circuit 7 is such a constant voltage circuit having a voltage value "e" smaller than the voltage value V of the power source E. The changing switch SW2 is so arranged that such a selecting line different from the selecting line 5 connected to the positive polarity terminal of the power source E by way of the changing switch SW1 is connected to a positive polarity terminal of this constant voltage circuit 7.

Next, a description will now be made of recording operations performed in the thermal head according to the present invention.

Similar to the above-described conventional thermal head, when the recording operation is carried out by the thermal head of the present invention, the control unit 8 subdivides the recording data for 1 line into A phase recording data processed by the A phase thermal resistance elements which are in contact with both sides of the first lead conductors 3 connected to the first selecting line 5A, and into also B phase recording data processed by the B phase thermal resistance elements which are in contact with both sides of the second lead conductors 4 connected to the second selecting line 5B. At the first timing, the control unit 8 controls the changing switch SW1 to thereby connect the first selecting line 5A to the power source E, and further transmits the A phase recording data to the drive IC2 so as to turn ON/OFF the switches S. As a result, the A phase thermal resistance elements are heated. At the second timing, the changing switch SW1 is switched at preselected timing, so that the second selecting line 5B is connected to the power source E. Also, the control unit transmits the B phase recording data to the drive IC2 so as to turn ON/OFF the switches S1 to Sn, so that the B phase thermal resistance elements are heated, and thus the recording operation for 1 line is complete.

In the case that the recording operation is carried out by the A phase thermal resistance elements located in contact with both sides of the first lead conductors 3 connected to the first selecting line 5A, the control apparatus 8 of the thermal head according to the present invention controls the changing switch SW2 to connect the second selecting line 5B to the constant voltage circuit 7, so that a potential "e" is applied to the second selecting line 5B. When the recording operation is carried out by the B phase thermal resistance element, the control apparatus 8 of this thermal head controls the switch SW2 to connect the first selecting line 5A to the constant voltage circuit 7, so that the potential "e" is applied to the first selecting line 5A, namely the first lead conductor group. That is, the control apparatus 8 is operated in such a manner that when the changing switches SW1 and SW2 are sequentially switched in synchronism with each other in order that any one of these selecting lines is selected for the printing operation, a predetermined potential is applied to the other selecting line.

Figure 4:
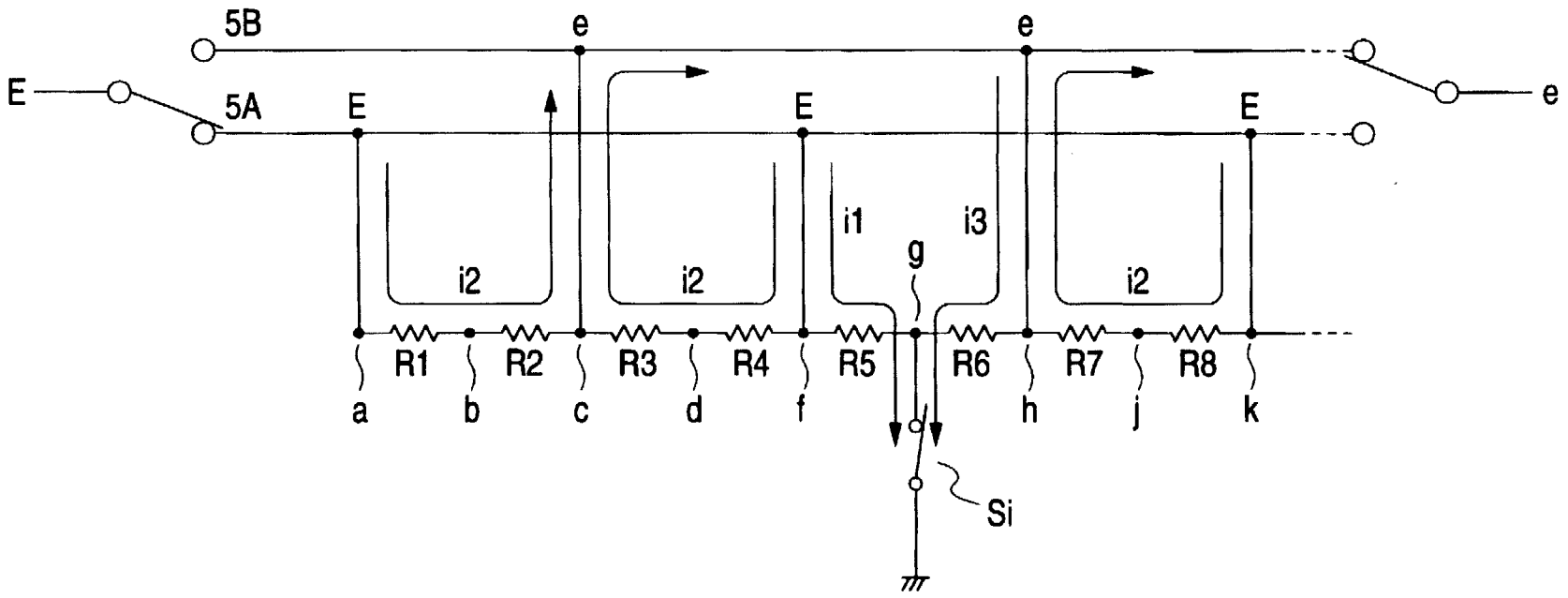
FIG. 4 is a connection diagram for representing a voltage and a current of the thermal head according to the present invention.

FIG. 4 is a connection diagram for showing a voltage and a current of the thermal head according to the present invention. In this drawing, there is shown such a condition that only the thermal resistance element group belonging to the first selection line 5A is heated. More specifically, the first selection line 5A connects via SW1 to the power source E, and the second selection line 5B connects via SW2 to the constant voltage 7. Accordingly, the contacts "a", "f" and "k" are applied with the potential "E", and the contacts "c" and "h" are applied with the potential "e", respectively.

Incidentally, the contacts "b", "d" an "j" are connected via the third lead conductors 6 to the switches within the drive IC2, but in this drawing these are omitted.

It is now assumed that the switch Si employed within the drive IC2 is closed. At this time, the thermal resistance element to be heated corresponds to R5. The power source E and the ground are connected to contacts "f" and "g" of both ends of this thermal resistance element R5, respectively. A potential difference between this section "f" and "g" becomes E, so that a current of $i1=E/R$ may flow through the thermal resistance element R5.

Also, potentials "e" derived from the constant voltage circuit 7 are applied to a section "a" to "c", another section "f" to "c", another section "k" to "h", - - - . Since $E>e$, a potential difference thereof becomes $E-e$. A current $i2=(E-e)/2R$ may flow through the thermal resistance elements (R1, R2), (R3, R4), (R7, R8), - - - within the respective sections. Furthermore, the ground and the constant voltage circuit 7 are connected to the contacts "g" and "h" at both ends of the thermal resistance element R6 located adjacent to the thermal resistance element R5 to be heated, which may cause a potential difference "e" between this section of "g" and "h". As a consequence, a current $i3=e/R$ may flow through the thermal resistance element R6.

Now, in order to increase a difference between the heat radiation amount of the thermal resistance element (R5 in the drawing) to be heated and the heat radiation amount of other thermal resistance elements (R1, R2, R3, R4, R6, R7, - - - , in the drawing), the voltage "e" of the constant current circuit 6 may be defined within a range of $0<e<E$ in such a manner that with respect to the current i1 flowing through the thermal resistance element (R5) to be heated, both the current i3 flowing through the thermal resistance element (R6) adjacent to this thermal resistance element (R5) and the current i2 flowing through other thermal resistance elements become small.

The case where the previously explained conventional diodeless type thermal head is equivalent to such a case that the voltage "e" of this constant voltage circuit 7 is set to 0. In this case, as previously described, $i3=0$, and $i2=E/2R$. To the contrary, according to the present invention, a preselected potential is applied to the selecting lines which are used irrelevant to the printing operation, in order to reduce the round currents (i2, i3).

In accordance with this embodiment, the voltage "e" of the constant voltage circuit 7 is set in such a manner that $i2=i3$. As a result, the applied energy (power consumption) by the thermal resistance elements which are not used for the color printing operation is reduced. In other words, when the equation $i2=i3$ is substituted by the above-explained formula, it is given as $(E-e)/2R=e/R$. When this formula is simplified, it is given as $e=\frac{1}{3}\times E$. Accordingly, since the voltage "e" of the constant voltage circuit 7 is set to $\frac{1}{3}$ voltage E of the power source, the printing energy of the thermal resistance elements which are not heated becomes $i2\times i2\times R=\frac{1}{9}\times(E\times E)/R$, so that this printing energy can be reduced to $\frac{1}{9}$ with respect to the printing energy $((E\times E)/R)$ of the thermal resistance element to be heated. In this case, a constant current may flow through the thermal resistance elements which are not heated irrelevant to such a condition as to whether or not the thermal resistance elements which are not heated are located adjacent to the thermal resistance element to be heated. When the temperature control of the thermal resistance elements is carried out, this control operation can be simplified.

Figure 5:
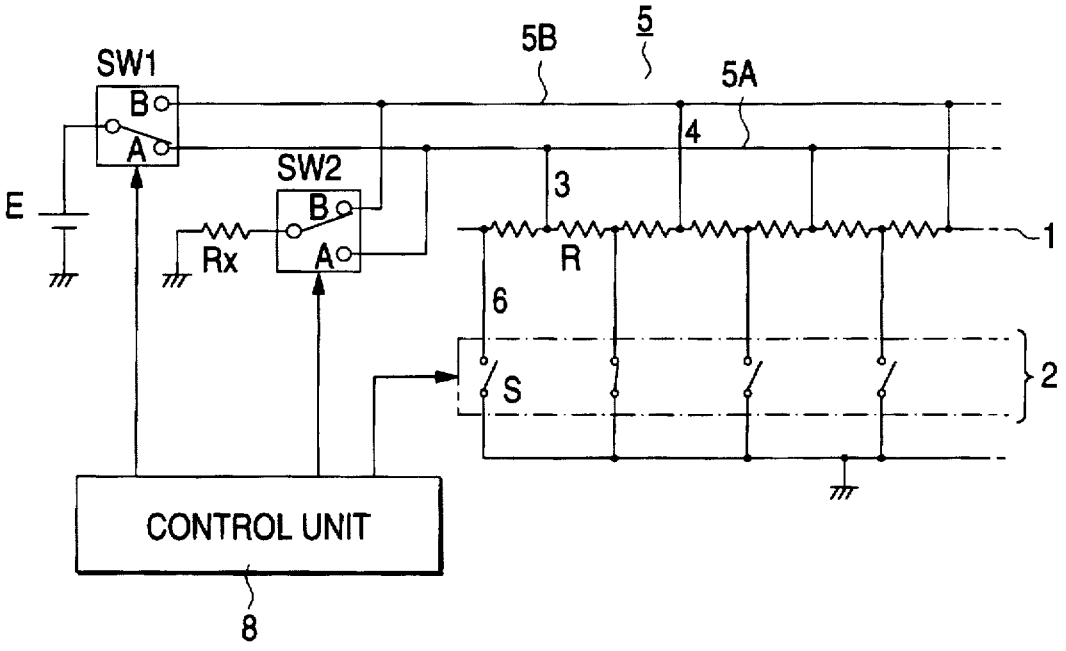
FIG. 5 is a diagram for indicating a second embodiment of the present invention.

FIG. 5 is a circuit diagram for representing a second embodiment of the present invention. A different point of this second embodiment is given as follows, with respect to the first embodiment. That is, the first changing switch SW1 is switched at preselected timing to sequentially connect the first and second selecting lines to the power source E. At the same time, the second changing switch SW2 is switched in synchronism with the switching operation of this first changing switch SW1 so as to connect the other selecting line 5 via a resistor Rx to the ground. Also, when the recording operation is performed by the A group's thermal resistance elements, the second selecting line 5B is connected via the resistor Rx to be grounded.

Figure 6A:
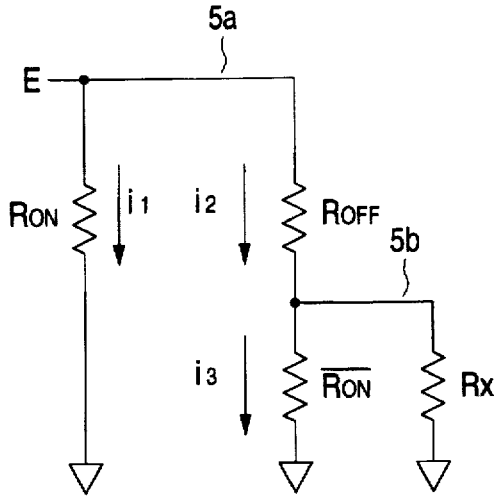
FIGS. 6A and 6B are diagrams showing equivalent circuits of the second embodiment of the present invention.
Figure 6B:
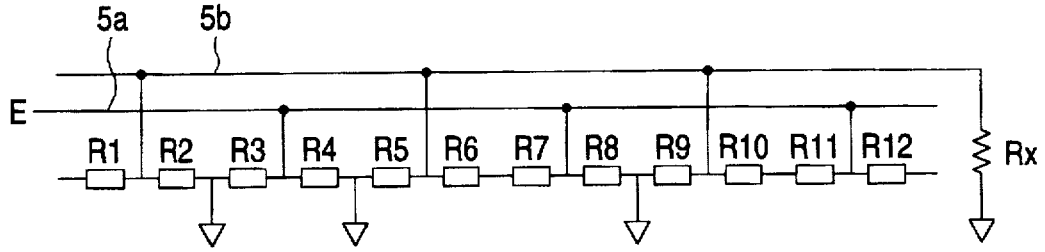

FIGS. 6A and 6B are equivalent circuits when a first selecting line 5a is set under energizing condition, and when a second selecting line 5b is grounded via the resistor Rx to establish the A group's thermal resistance elements driving state. Symbol R (ON) shown in this drawing indicates a combined resistance value of all of the thermal resistance elements (i.e., R3, R4, R8 shown in FIG. 6B) which are designated "print ON". Symbol R (ON) bar denotes a combined resistance value of the thermal resistance elements (i.e., R2, R5, R9 indicated in FIG. 6B) which are designated "print OFF" and are located adjacent to the thermal resistance element to be heated. Symbol R (OFF) represents a combined resistance value of the thermal resistance values (i.e., R1, R6, R7, R10, R11, R12 shown in FIG. 6B) which are designated "print OFF" and are not located adjacent to the thermal resistance element to be heated. Assuming now that the currents flowing through the combined resistance values R (OFF) and R (ON) bar are I1, I2; a quantity of all thermal resistance elements is N; a quantity of thermal resistance elements to be heated is Non; and the resistance values of the respective thermal resistance elements are R, the above-described R (OFF) and R (ON) bar expressed by the following formulae:

$$R(\mathrm{OFF}) = \frac{2R}{\frac{N}{2} - Non} = \frac{4R}{N - 2Non} \tag{1}$$

$$\overline{R(\mathrm{ON})} = \frac{R}{Non} \tag{2}$$

By using these formulae (1) and (2), a current In flowing through one thermal resistance element located adjacent to the thermal resistance element to be heated, namely the current flowing through one R (ON) bar, and another current Ie flowing through one thermal resistance element which is not heated, namely the current flowing through one R (OFF) are expressed by the following formulae:

$$\begin{aligned} In &= \frac{I_2}{Non} \\ &= \frac{1}{Non} \times \frac{E}{\frac{4R}{N-2Non} + \frac{R \cdot Rx}{R + Non \cdot Rx}} \times \frac{Rx}{R + Non \cdot Rx} \end{aligned} \tag{3}$$

$$Ie = \frac{E}{\frac{4R}{N-2Non} + \frac{R \cdot Rx}{R + Non \cdot Rx}} \times \frac{2}{N - 2Non} \tag{4}$$

Figure 7:
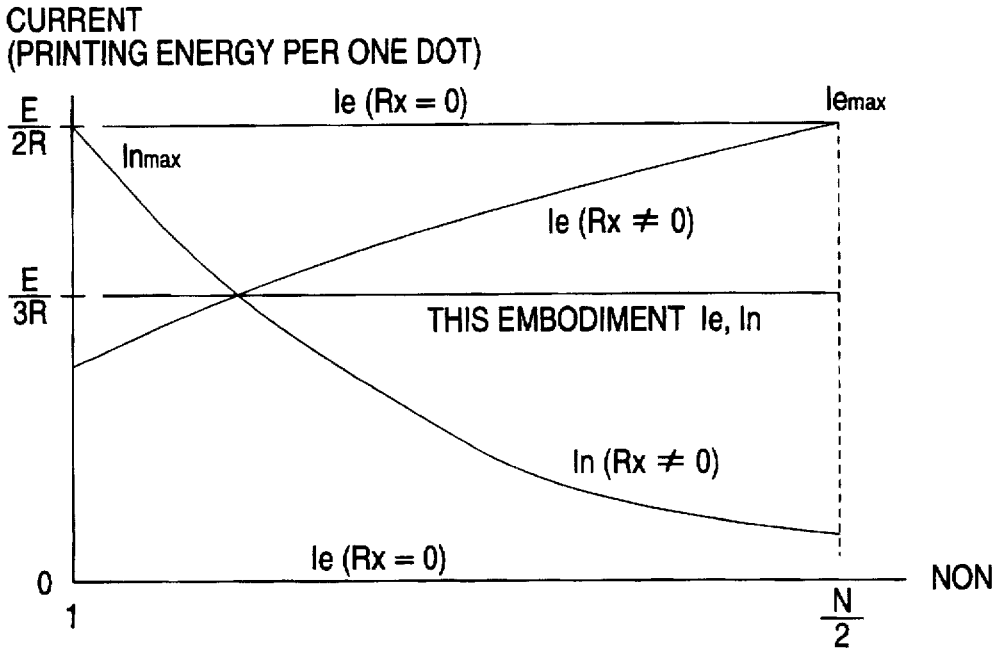
FIG. 7 is an explanatory diagram for indicating a characteristic of voltage/current in the second embodiment.

Now, when the voltage E of the power source, the resistance value R of the thermal resistance element, the thermal resistance element number N of the thermal head, and the resistance value of arbitrary resistance member Rx, which are the defined values, are substituted for the above-calculated formulae (3) and (4), a relationship between the currents In, Ie flowing through the thermal resistance elements which are not heated, and the number Non of thermal resistance elements to be heated is indicated in FIG. 7. As shown in this drawing, there is such a characteristic that the current Ie is simply increased with respect to an increase in Non, and the current In is simply decreased, and further the currents flowing through the respective thermal resistance elements which are not heated will be varied in response to the ratio of the number Non's of the thermal resistance elements to that of the whole thermal resistance elements employed in the thermal head (namely, printing ratio). As a consequence, when the resistance value of the resistor Rx is determined, the resistance value Rx is substituted for the above-described formulae (3) and (4) to obtain a variation figure of the currents Ie and In, from which an optimum value of the resistance value Rx may be obtained.

Figure 1:
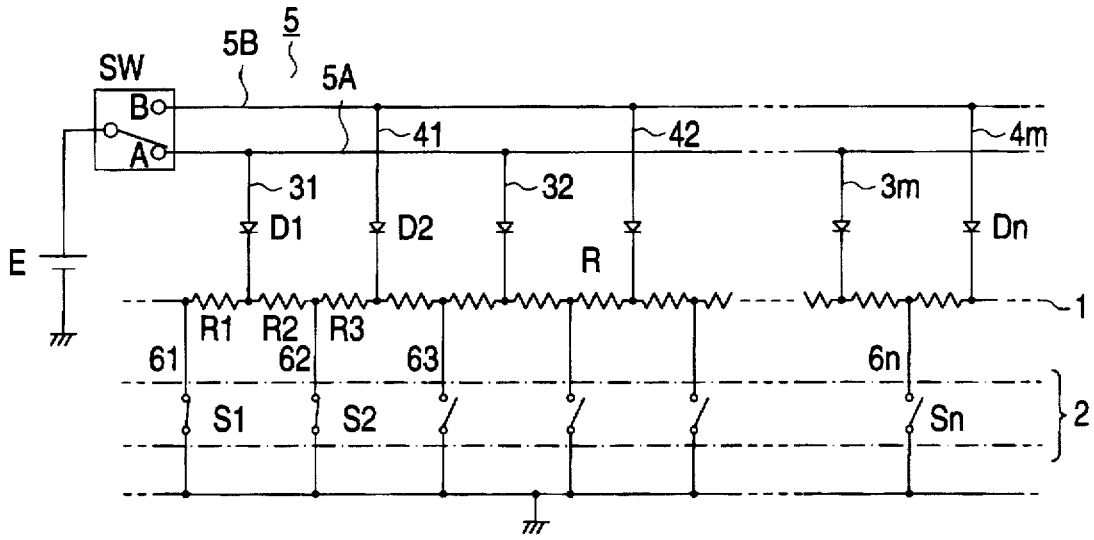
FIG. 1 PRIOR ART
FIG. 1 is a diagram for showing the structure of a conventional alternate lead type thermal head.
Figure 2:
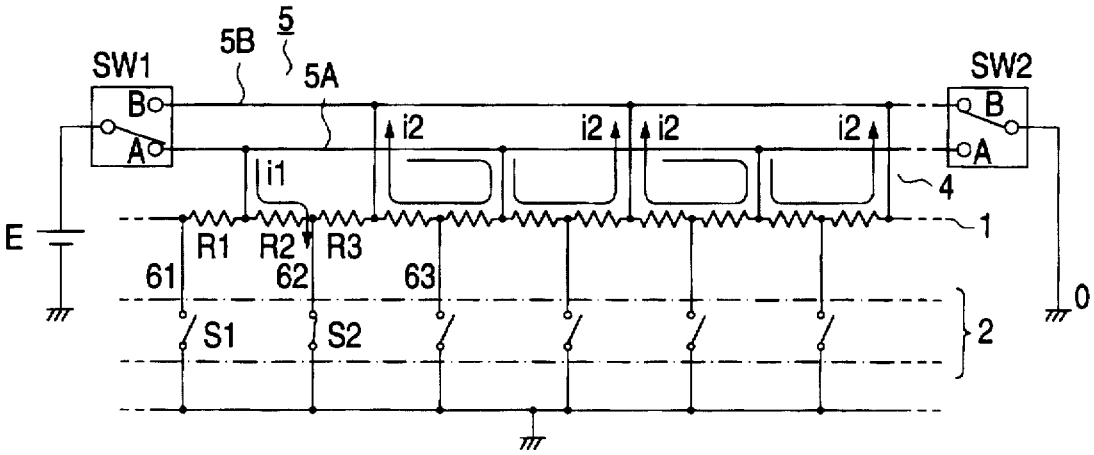
FIG. 2 PRIOR ART
FIG. 2 is a diagram for representing another conventional diodeless type thermal head.

In the above-described conventional thermal head in FIG. 2, it is set to Rx=0, so that Ie=E/2R and In=0 irrelevant to the printing ratio. In the first embodiment, the currents Ie and In are set to E/3R by way of the potential applying means irrelevant to the printing ratio. It should be noted that although the ordinate of FIG. 7 indicates the current value, since the resistance values of the respective thermal resistance elements are assumed as R, the squared current value may express the printing energy ratio. That is, assuming now that the printing energy of the thermal resistance elements (R3, R4, R8 in FIG. 6B) to be printed out is set to 1 (current value E/R). In the conventional thermal head in FIG. 2, when Rx=0, the printing energy of the adjoining thermal resistance elements (R2, R5, R7 in FIG. 6B) is ¼, and the printing energy of other thermal resistance elements is 0. In the first embodiment, the energy caused to the elements other than the elements are heated becomes ⅙. In the second embodiment, the energy of the thermal resistance elements which should not be heated can be set less than at least ¼ by properly selecting the resistance value Rx. In this case, the value of Rx is varied in accordance with the printing ratio, so that the difference between the energy of the thermal resistance element to be heated and the printing energy of the thermal resistance elements not to be heated can be continuously made large.

As in the second embodiment of the present invention, the other group different from the exciting group is grounded via the resistor Rx, so that such a potential having an essentially large value is produced in the non-exciting group by this resistor Rx. This potential having the essentially large value at the non-exciting group can reduce the leak current influencing the thermal resistance elements which should not be originally heated.

Subsequently, a description will be given of a head drive circuit of a printing head according to the present invention.

First, the principle of a head drive circuit according to a third embodiment of the present invention will be explained with reference to FIG. 8.

Figure 8:
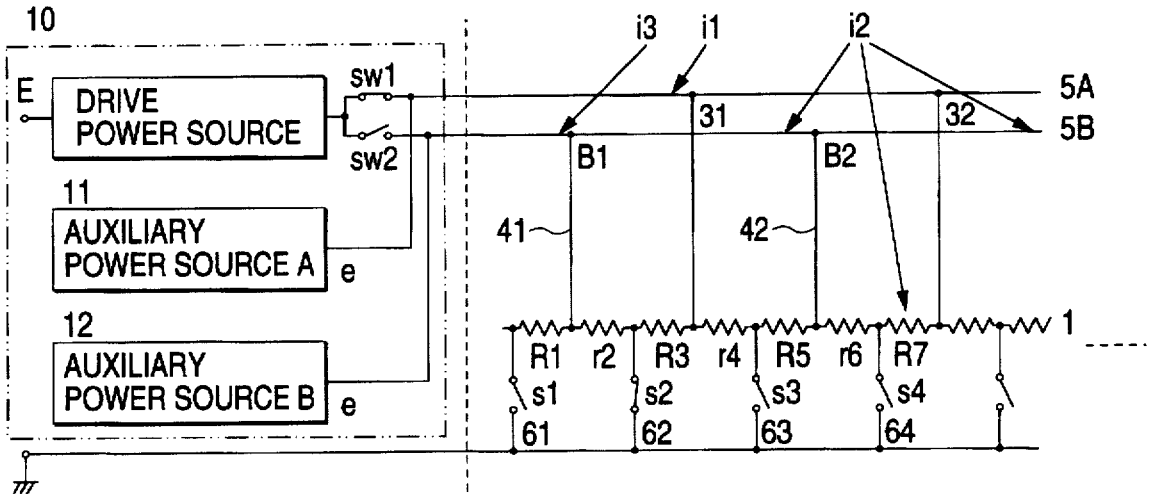
FIG. 8 is a structural diagram showing a thermal head drive circuit according to a third embodiment of the present invention.

As represented in FIG. 8, it is now assumed that a drive potential E is applied to the first selecting line 5A, and a potential e derived from an auxiliary power source B is applied to a second selecting line 5B, so that an A group is under drive state. In this drawing, the third lead conductor 62 is grounded via switch s2 within the drive IC2 (not shown), and only the thermal resistance element R3 shall be heated. The current i1 flows into the element R3, the current i3 flows into the element R2 adjacent to the element R3, and the current i2 flows the rest of the elements R4, R5 . . . . In this case, in order to equal the energy given to the each element other than the element R3, current i2 may be equal to the current i3.

As to i2, i2=(E−e)/(r4+r5)=(E−e)/(r6+r7).

As to i3, i3=e/r2. Note that symbol E indicates a drive potential at a driven group, symbol e shows a potential at a group different from the driving group, and symbols r2, r4 and r5 represent resistance values of the respective thermal resistance elements.

Accordingly, e/r2=(E−e)/2*r2 (it is assumed that the resistance values of the respective thermal printing elements are identical to each other). It is given as follows: e=E/3.

A ⅓ potential of the drive power source may be applied to the second selecting line 5B.

It should be noted that in this printing head, a printing operation is carried out in a manner that the A group and the B group are alternately and sequentially switched into the drive group and the non-drive group. A switch sw1 and a switch sw2 shown in FIG. 8 are an interlock switch for performing the above-described switching operations.

As described above, in accordance with the printing head of the present invention, since the potential of the non-drive group is set to ⅓ of the potential at the drive group, the energy given to the thermal printing elements which are not driven for the printing operation can be made constant. The amount of this energy given to the respective thermal printing elements which are not driven for the printing operation is defined as follows:

$(E/3\times E/3)/r=\frac{1}{9}\times(E\times E/r)$, if the resistance value of each thermal printing element is equal to "r".

As a consequence, this energy amount becomes ⅑, as compared with the amount of energy (E×E/r) applied to the thermal printing elements driven during the printing operation. As described above, in accordance with the present invention, the ratio of energy applied to the thermal printing elements driven for the printing operation to energy applied to the thermal printing elements not driven for the printing operation may be set to ⅑, so that the control of the printing density may be easily.

On the other hand, when such a printing head is driven, a total value of the currents i3 would exceed a total value of the current i2 in accordance with the number of the driven thermal printing elements. When the driven element number is small, namely a total value of the currents i2 is larger than a total value of the currents i3, the large amount of the current would be allowed to flow into the second selecting line 5B. Conversely, when the driven element number exceeds the specific driven element number, so that a total value of the currents i3 exceeds a total value of the currents i2, the current flown from the second selecting line 5B would become high. Accordingly, when such a printing head is driven, it is desirable to employ such a power source capable of effectively causing the current to flow in and out.

A auxiliary power source "A" and a auxiliary power source "B" of a thermal head power source 10 shown in FIG. 8 represent one example of such a power source. These two auxiliary power sources "A" and "B" maintain the first selecting line 5A and the second selecting line 5B at a predetermined potential "e" when the A group and the B group of the respective thermal heads are set to non-driven states. In this case, when the A group is set to the driven state, the auxiliary power source A which is connected to the first selecting line 5A is brought into inactive operation, whereas when the B group is set to the driven state, the auxiliary power source B which is connected to the second selecting line 5B is brought into inactive operation. It should be noted that any one of the auxiliary power sources A and B may be arranged by the same structure.

Figure 9:
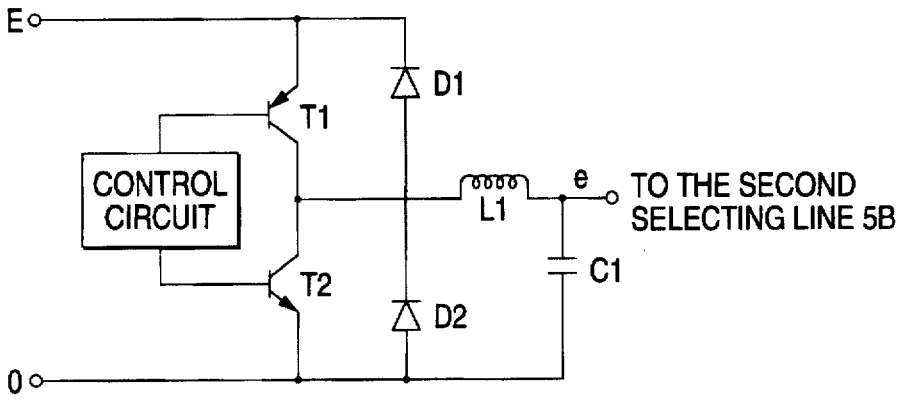
FIG. 9 is a structural diagram showing an auxiliary power source indicated in FIG. 8.

FIG. 9 is an explanatory diagram for indicating one structural example of these auxiliary power sources. As indicated in FIG. 8, when the A group is in the driven states, the auxiliary power source B which is connected to the second selecting line 5B is brought into the operation condition. At this time, the output terminal of the auxiliary power source B shown in FIG. 9 is operated in such a manner that the second selecting line 5B is maintained at the potential "e".

In such a case that a total number of thermal printing elements driven in the A group is relatively small, namely an amount of current entering into the second selecting line 5B caused by the current i2 is increases, a potential at the output terminal of the auxiliary power source of FIG. 9 would be increased. Conversely, when the total number of driven thermal printing elements is large, a potential at the output terminal of the auxiliary power source would be decreased because the current i3 flows out from the second selecting line 5B.

In the former case, an ON signal is sent from a control circuit of FIG. 9 to a second transistor T2, so that an LC circuit constructed of a coil L1 and a capacitor C1 is discharged, and thus a potential at an output terminal portion thereof is set to approximately "e". In the latter case, an ON signal is supplied to a first transistor T1 so as to charge the LC circuit, so that the potential at the output terminal portion thereof is maintained at "e". It should be noted that although not shown in FIG. 9, the output from this auxiliary power source is fed back to the control unit, and the first and second transistors T1 and T2 are automatically controlled in response to a variation in this output.

It should also be noted that since a control circuit of the auxiliary power source A having the same structure as the auxiliary power source B supplies an OFF signal to the first and second transistors T1 and T2, this auxiliary power source A connected to the A group corresponding to the driven group is brought into the inoperative condition.

Figure 10:
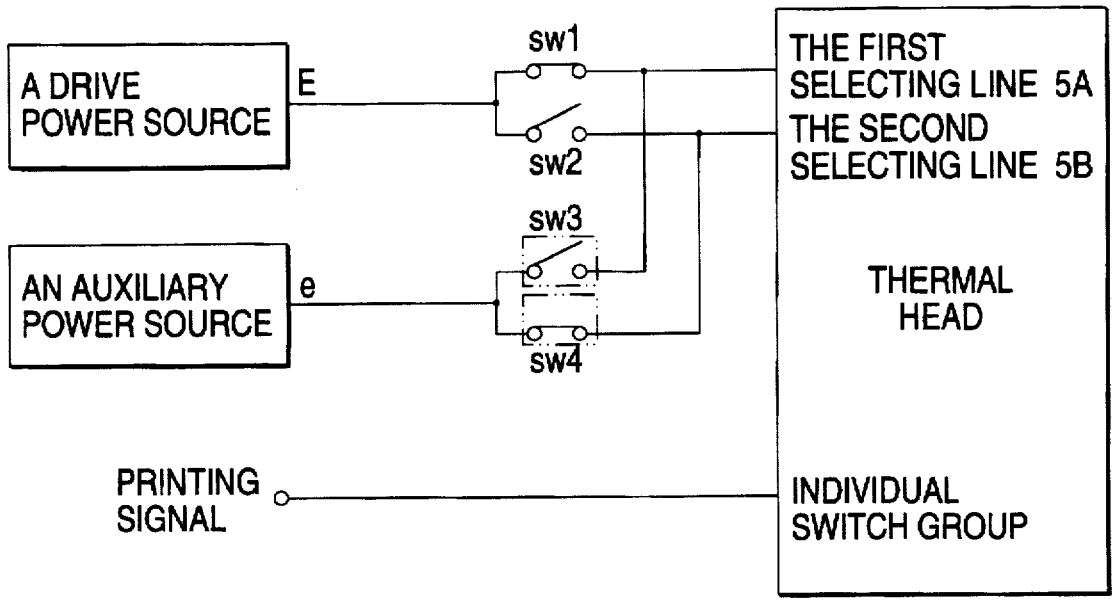
FIG. 10 is a structural diagram showing a printing head drive circuit according to a fourth embodiment of the present invention.

FIG. 10 is an explanatory diagram for representing another example of the thermal head drive circuit related to a fourth embodiment of this invention. When the thermal printing element belonging to the A group of the thermal head is driven, a drive power source for producing a potential E is connected to a first selecting line 5A by way of sw1, and a auxiliary power source for producing a potential "e" is connected to a second selecting line 5B by way of sw4. Similarly, when the thermal printing element belonging to the B group of the thermal head is driven, the drive power source for producing the potential E is connected to the second selecting line 5B by way of sw2, and the auxiliary power source for producing the potential "e" is connected to the first selecting line 5A by way of sw3.

In this case, the switches sw3 and sw4 both connected to the auxiliary power sources may be preferably a bidirectional switch, since the auxiliary power source owns both the current sinking effect and the current supplying effect. However, the normal bidirectional switch having the mechanical contacts, for example, a relay and the like can be hardly used in the thermal head for the printing operation by alternately switching the A group and the B group. This is because the A group and the B group should be rapidly switched so as to perform the high speed printing operation.

Figure 11:
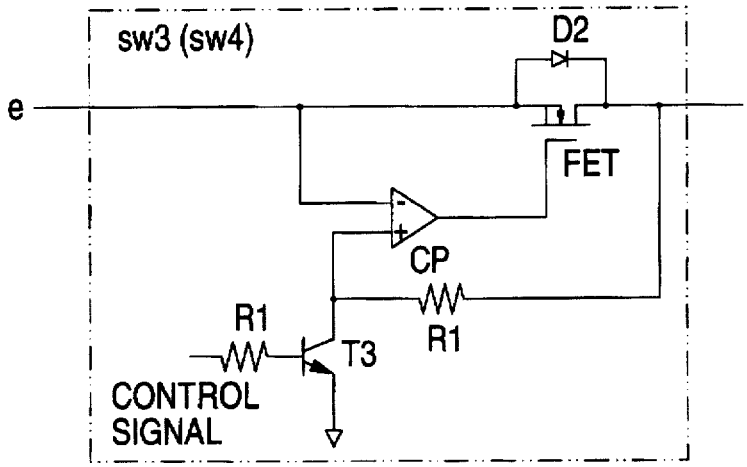
FIG. 11 is an explanatory diagram for representing an example of the bidirectional switch of FIG. 10.

Accordingly, in this embodiment apparatus, such a bidirectional switch as indicated in FIG. 11 is employed. The necessary conditions of this bidirectional switch are given as follows: a) When the auxiliary power source is brought into the operation condition, the bidirectional switch can cause the currents to flow in both direction. b) When the auxiliary power source is brought into the inactive condition, this switch can block the current flow from the drive power source to the auxiliary power source even when the switch is not completely interrupted in view of circuitry. When the bidirectional switch sw3 (sw4) is turned ON to thereby connect the auxiliary power source of FIG. 10 to the corresponding first (second) selecting line, a control signal of FIG. 11 is set to a low level. Then, the transistor T3 is turned OFF. As a result, if the potential at the auxiliary power source is higher than the potential at the first (second) selecting line, then the current can be supplied through a diode D2 from the auxiliary power source to the first (second) selecting line. Conversely, if the potential at the auxiliary power source is lower than the potential at the first (second) selecting line, then an output from a comparator CP becomes a high level, so that an FET is turned ON. As a consequence, a current may flow from the first (second) selecting line at the high potential toward the auxiliary power source.

In such a case that the bidirectional switch sw3 (sw4) is turned OFF to thereby separate the auxiliary power source from the corresponding first (second) selecting line, the control signal of FIG. 11 is set to a high level. At this time, the transistor T3 is turned ON, and the output from the comparator CP continuously becomes a low level. As a consequence, since the OFF state of the FET is maintained, no current flowing toward the auxiliary power source is produced. It should be noted that this bidirectional switch of FIG. 11 may connect the auxiliary power source with the first selecting line 5A in view of circuiting even when the bidirectional switch sw3 shown in FIG. 10 is brought into the open state. However, since the potential "e" of the auxiliary power source is lower than the potential E of the drive power source and the FET of FIG. 11 is OFF as mentioned above, neither the current flows from the auxiliary power source to the first selecting line 5A, nor the current conversely flows from the power source line to the auxiliary power source. In other words, it is equivalent that this bi-directional switch sw3 is electrically cut out.

Now, a head drive circuit according to a fifth embodiment of the present invention will be explained with reference to FIG. 12. The head drive circuit in FIG. 12 is substantially identical with that in FIG. 8 except for a thermal head power source 10, and therefore a description will be given of only the thermal head power source 10 below.

Figure 12:
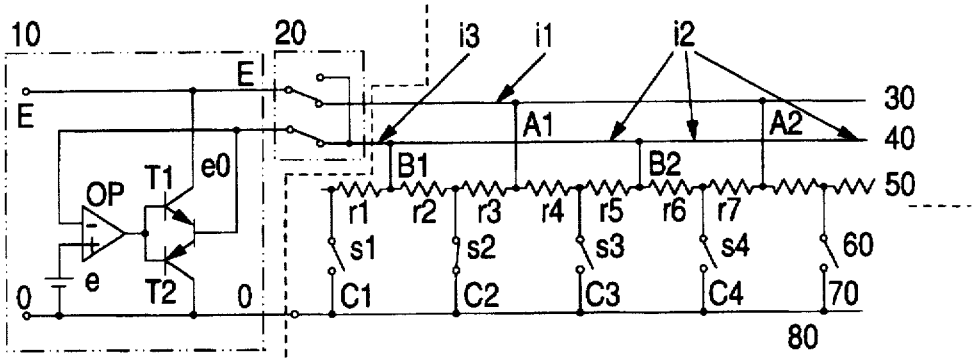
FIG. 12 is a structural diagram showing a thermal head drive circuit according to a fifth embodiment of the present invention.

The thermal head power source 10 shown in FIG. 12 represents an example of such a power source. This thermal head power source 10 is so arranged that an operational amplifier OP equipped with a power amplifier at an output stage is employed, and a voltage feedback is given in order that an output voltage becomes an auxiliary voltage "e".

A reference voltage "e" (namely, a target value of the auxiliary voltage) is applied to a noninverting input terminal of the operational amplifier OP. On the other hand, an output "e0" (an auxiliary voltage value to be controlled) of the power amplifying means constructed of two transistors T1 and T2 are directly fed back to an inverting input terminal. As a result, in this circuit, such a control of "e0=e" is carried out.

Assuming now that, as indicated in FIG. 12, the total number of driven thermal printing elements is small and the amount of currents flowing into the second selecting line 5B is increased, via the second transistor T2, more current flows into the ground so that the output voltage "e0" is approximated to the reference voltage "e". Conversely, when the total current flown from the second selecting line 5B (the total current i3) is increased, via the first transistor T1, more current flows into the second selecting line 5B, so that the output voltage "e0" is approximated to the reference voltage "e".

In accordance with the method shown in FIG. 12, the arrangement is made simple and also the better output stability could be achieved. This method is suitable able for such a case that the printing head having a relatively small number of thermal printing elements is driven.

Figure 13:
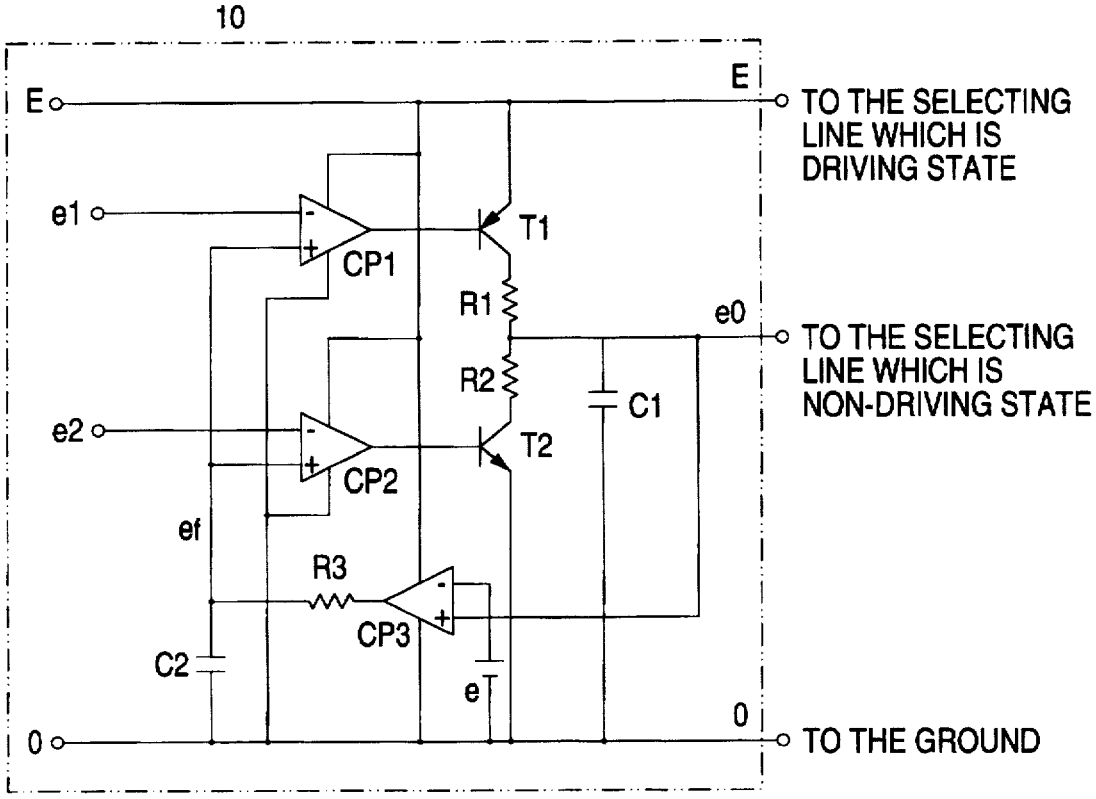
FIG. 13 is a structural diagram showing a thermal head power source according to a sixth embodiment of the present invention.

FIG. 13 is a circuit diagram showing a sixth embodiment of such a thermal head power supply. In this method, a switching device is turned ON/OFF in response to a variation in the output voltage "e0", so that an RC circuit of an output stage is charged/discharged.

Figure 14:
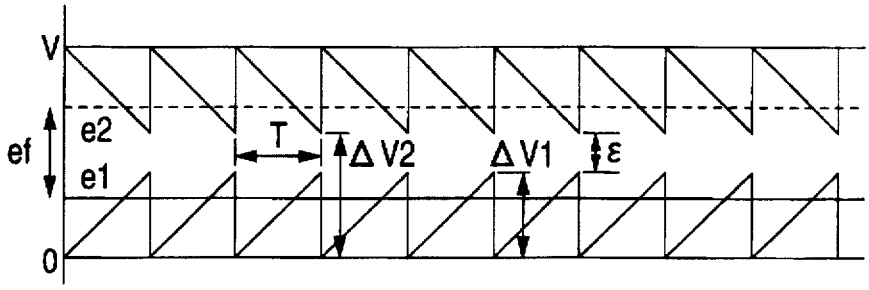
FIG. 14 is a control explanatory diagram showing the thermal head power source of FIG. 13.

A reference voltage "e" is applied to an inverting input terminal of a comparator CP3, and the output voltage "e0" is applied to a noninverting input terminal thereof. Then, an integrating circuit constructed of a resistor R3 and a capacitor C2 is connected to the output stage of this comparator CP3 so as to thereby produce an output "ef". Also, a sawtooth wave having a period "T" and a crest value "ΔV2" as "e1" in FIG. 14, is supplied to an inverting input terminal of a comparator CP1. Another sawtooth wave having a period "T" and a crest value changed between "V" and "ΔV2" as "e2" in FIG. 14, is supplied to an inverting input terminal of a comparator CP2. Then, the above-described output "ef" of the integrating circuit is supplied to the noninverting input terminals of these comparators CP1 and CP2.

Figure 15:
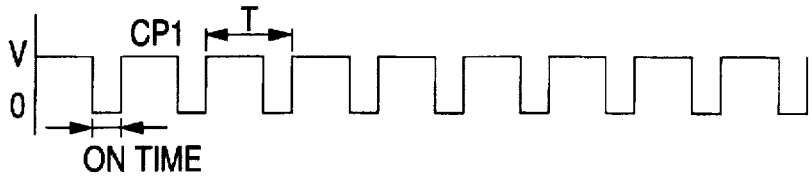
FIG. 15 is another control explanatory diagram of the thermal head power source of FIG. 13.

When the output "e0" of the selecting line 5 which is non-driving state is smaller than the reference voltage "e" connected to the inverting input terminal of the comparator CP3, namely the current flown out from the non-driving selecting line is increased, the output from the comparator CP3 becomes 0 (zero). Accordingly, the output "ef" from the integrating circuit constructed of the resistor R3 and the capacitor C2, which is connected to this output, is decreased toward 0 (zero). At this time, the output from the comparator CP1 becomes a rectangular wave series as illustrated in FIG. 15 when it is "ef"<ΔV1. In this time, the output "ef" becomes the smaller, the width of this rectangular wave becomes the wider. This rectangular wave output from the comparator CP1 becomes a signal for driving the first transistor T1 at the next stage, and repeatedly causes the first transistor T1 to become conductive only during ON time of the potential 0 (zero) shown in FIG. 15. As a consequence, the current from the power source E charges an integrating circuit constructed of a resistor R1 and a capacitor C1 via the first transistor T1, so that the output "e0" is increased.

On the other hand, when the output "e0" is larger than the reference voltage "e", namely when the current flown into the selecting line which is non-driving state is increased, the comparator CP2 is operable. The comparator CP2 is operated so as to discharge the integrating circuit constructed of the resistor R2 and the capacitor C1, which constitutes a symmetrical operation of the previously explained comparator CP1.

As described above, in accordance with this circuit, in response to increases/decreases of the output "e0" as the auxiliary potential, the current is swept out and supplied therein, so that the output "e0" can be maintained within a certain range where the reference voltage "e" is present at a center thereof. It should be noted that the values of the above-described ΔV1 and ΔV2 may have such values: (ΔV1+ε): (ΔV2+ε)=e: (V−e). Note that symbol "ε" shows a width of an insensitive range where the first and second transistors T1 and T2 are not turned ON at the same time in response to the change in the output "ef".

In accordance with the above-described method, since the two transistors are controlled under only two conditions of the saturated region and the nonconductive condition, the loss would be decreased. As a consequence, such a printing head having larger numbers of printing elements than that of the previous method can be driven.

Figure 16:
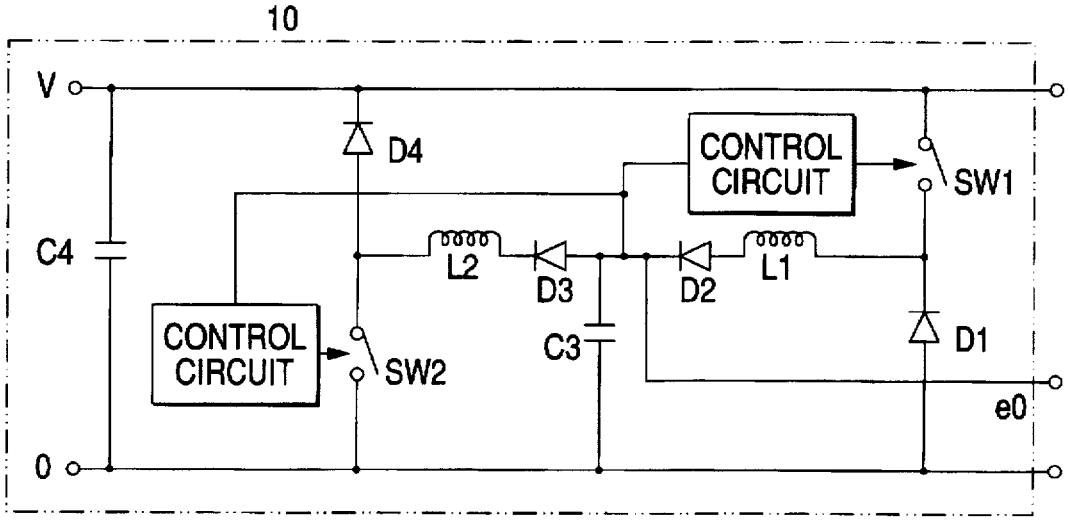
FIG. 16 is a structural diagram showing a thermal head power source according to a seventh embodiment of the present invention.

FIG. 16 is a circuit diagram showing a thermal head power source 10 according to a seventh embodiment of the present invention. An output "e0" as the auxiliary potential is derived from a junction point between a first inductance L1 and a second inductance L2. An LC circuit arranged by the inductance L1 and a capacitor C3 may be charged by turning ON a first switch SW1, so that the output "e0" may be increased. Also, another LC circuit constructed of the inductance L2 and the capacitance C3 may be discharged by turning On a switch SW2, so that the output "e0" may be decreased. As a result, the output "e0" is monitored by a control circuit, and also any one of the first switch SW1 and the second switch SW2 are turned ON/OFF in response to a difference between this output "e0" and the reference voltage "e", so that the output "e0" can be maintained within a predetermined range where the reference voltage "e" is present as a center thereof.

It should be noted that this circuit has such a merit that there is no portion which produces Joule's heat, as compared with the circuits of the previously explained embodiments. As a consequence, even when the difference between the entered current and the derived current is large under such a condition that the printing head having a large number of printing elements is used, only such a heat dissipating means applied to the normal power element may be employed. Furthermore, when the first switch SW1 and the second switch SW2 are constituted by transistors, the control circuit for employing the comparators previously explained in the sixth embodiment may be used.

Figure 17:
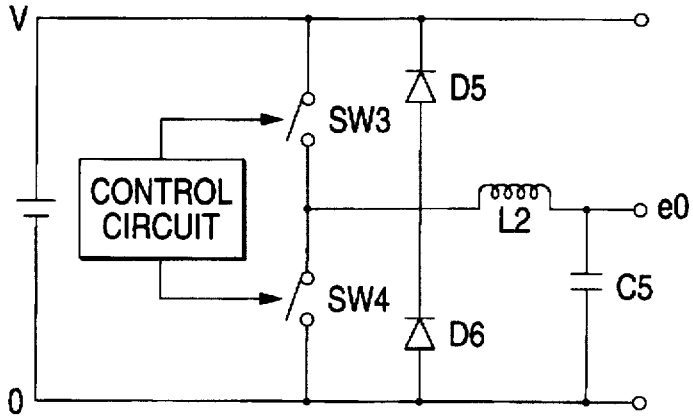
FIG. 17 is a structural diagram of a thermal head power source according to a fourth embodiment of the present invention.

Although the separate inductances have been used to sweep out the current and enter the current in the above-described embodiment, a single inductance may be operated for both functions by employing a circuit shown in FIG. 17. Alternatively, the inductances of FIG. 16 may be replaced by resistors.

As previously described in detail, in accordance with the thermal head of the present invention, since the diode with the lead conductor is no longer required, the manufacturing cost can be reduced and the thermal head can be made compact. Moreover, the heat radiation amount of the thermal resistance elements which are not heated is further lowered, and then the difference between the heat radiation amount of the thermal resistance elements not to be heated and the heat radiation amount of the thermal resistance elements to be heated can be made substantially equal to that of the conventional thermal head in FIG. 2. As a consequence, the control block, the control method, and the circuit components such as the power source, which have been employed in the conventional thermal head equipped with the diode can be directly employed. There is such an advantage that the cost increase caused by the design change could be suppressed. Also, in accordance with the second embodiment of the present invention, it is possible to reduce the heat radiation amount of the thermal resistance elements not to be heated in low cost by merely adding the resistance member.

As previously described, in accordance with the present invention, the drive circuit of the printing head can be constituted by employing a relatively low-cost circuit arrangement. Furthermore, since the auxiliary power source connected to the thermal head of this invention has a function of the current flowing into/from the non-energized selecting line, the amount of current of the non-energized selecting line can be substantially constant.

Furthermore, in such a printing head that the current may flow into/from the reverse phase different from the drive phase, it is possible to construct the printing head drive circuit capable of effectively accepting the current flown in/from operations.

What is claimed is:

1. A thermal head which has a thermal resistance member formed in a straight form, comprising:

a first lead conductor group having a plurality of first lead conductors which are connected to said thermal resistance member;

a second lead conductor group having a plurality of second lead conductors which are connected to said thermal resistance member, said first lead conductors and said second lead conductors being alternately arranged at a given interval;

a third lead conductor group connected to said thermal resistance member between said first and second lead conductor groups; and selecting means having a first selecting mode for selecting said first lead conductor group and a second selecting mode for selecting said second lead conductor group;

wherein when said selecting means selects said first selecting mode, a region of said thermal resistance member sandwiched by said first lead conductor group and said third lead conductor group is operated, and when said selecting means selects said second selecting mode, a region of said thermal resistance member sandwiched by said second lead conductor group and said third lead conductor group is operated;

wherein said selecting means includes a power source for applying a driving potential "E" to said first lead conductor group during the first selecting mode, and for applying a driving potential "E" to said second lead conductor group during the second selecting mode;

wherein said selecting means includes potential applying means for applying a potential other than 0 to said second lead conductor group during the first selecting mode, and for applying a potential other than 0 to the first lead conductor group during the second selecting mode; and wherein said potential applying means feeds back said potential given to said second lead conductor group to set said potential to a predetermined value "e" during the first selecting mode, and feeds back said potential given to said first lead conductor group to set said potential to a predetermined value "e" during the second selecting mode.

2. A thermal head as claimed in claim 1, wherein said potential "e" is equal to the potential "E/3".

3. A thermal head as claimed in claim 1, wherein said power source includes a first terminal which applies the driving potential "E" to the selected one of said first and second lead conductor groups which is operated, and said potential applying means comprises a second terminal which applies said predetermined potential "e" to the one of said first and second lead conductor groups which is not operated.

* * * * *